United States Patent [19]

Gomersall

[11] Patent Number: 4,637,441

[45] Date of Patent: Jan. 20, 1987

[54] INLET AND OUTLET VALVES

[76] Inventor: Rodney Gomersall, 82 Banks Road, Slaithwaite, Near Huddersfield, West Yorkshire, England

[21] Appl. No.: 763,308

[22] Filed: Aug. 5, 1985

Related U.S. Application Data

[63] Continuation-in-part of Ser. No. 578,141, Feb. 8, 1984, abandoned, which is a continuation-in-part of Ser. No. 503,533, Jun. 13, 1983, abandoned.

[30] Foreign Application Priority Data

Jun. 15, 1982 [GB] United Kingdom ..... 8217269

[51] Int. Cl.[4] ..... B65B 3/04

[52] U.S. Cl. ..... 141/349; 141/18; 141/351

[58] Field of Search ..... 141/4, 18, 20, 46, 51, 141/311, 319–322, 346–362, 383–386, 392

[56] References Cited

U.S. PATENT DOCUMENTS

| | | | |
|---|---|---|---|
| Re. 26,193 | 4/1967 | Labat | 141/348 X |
| 3,027,922 | 4/1962 | Weston et al. | 141/20 |
| 3,106,946 | 10/1963 | Gruenewald | 141/20 |
| 3,159,176 | 12/1964 | Russel et al. | 137/493.1 |
| 3,217,762 | 11/1965 | Burchett | 141/349 |
| 3,218,831 | 11/1965 | Newman | 141/20 UX |
| 3,286,741 | 11/1966 | Gellman | 141/18 |
| 3,318,346 | 5/1967 | Malter | 141/349 X |
| 3,476,507 | 11/1969 | Leeds | 141/348 X |
| 3,669,220 | 6/1972 | Andersson | 141/383 X |
| 3,934,626 | 1/1976 | Hall | 141/354 X |
| 4,406,314 | 9/1983 | Gomersall | 141/4 |

FOREIGN PATENT DOCUMENTS

| | | | |
|---|---|---|---|
| 229612 | 10/1963 | Austria | 141/348 |
| 2300426 | 7/1973 | Fed. Rep. of Germany . | |
| 2416836 | 10/1975 | Fed. Rep. of Germany | 141/346 |
| 1227311 | 8/1960 | France | 141/349 |
| 375164 | 6/1932 | United Kingdom . | |
| 833056 | 4/1960 | United Kingdom . | |
| 832507 | 4/1960 | United Kingdom . | |
| 961038 | 6/1964 | United Kingdom . | |
| 971871 | 10/1964 | United Kingdom . | |
| 1016334 | 1/1966 | United Kingdom . | |
| 1072480 | 6/1967 | United Kingdom . | |
| 1582701 | 1/1981 | United Kingdom . | |

*Primary Examiner*—Stephen Marcus
*Assistant Examiner*—Ernest G. Cusick
*Attorney, Agent, or Firm*—W. Thad Adams, III

[57] ABSTRACT

A carbonating cylinder containing carbon dioxide under pressure is provided with an outlet valve which is arranged to co-operate with an inlet valve mounted in the wall of a beer keg.

The outlet valve comprises a passageway having a reduced diameter portion opening into the carbonating cylinder and an enlarged diameter portion. An operating member is slidably mounted in the passageway and is releasably held therein by a screw extending through the wall of the valve into a reduced diameter portion of the operating member. The inner end of the operating member co-operates with a sealing member having an enlarged head which has a sealing ring which may sealably engage the wall of the cylinder. The outer end of the operating member has a discharge nozzle which extends axially into the member and communicates with the passageway via transverse ducts.

In use, the discharge nozzle of the outlet valve on the carbonating cylinder is brought into contact with the flared mouth on the body of the inlet valve of the beer keg and the two parts are urged against each other. The operating member moves in its passageway to engage and urge the sealing member inwardly to allow carbon dioxide to flow past the sealing member and through the passageway in the body of the inlet valve, past the flexible sleeve and into the keg.

4 Claims, 5 Drawing Figures

INLET AND OUTLET VALVES

This application is a continuation-in-part of application Ser. No. 578,141, filed 2/8/84, abandoned, which application is a continuation-in-part of application Ser. No. 503,533 filed on 6/13/83, now abandoned.

FIELD OF INVENTION

This invention relates to valves for pressure vessels. The invention is particularly, although not exclusively concerned with outlet valves for pressure vessels.

SUMMARY OF THE INVENTION

According to one aspect of the present invention, in an inlet and an outlet valve for respective pressure vessels, adapted to co-operate with each other to transfer pressure fluid from one of the vessels to another, the outlet valve includes a sealing member, said sealing member being adapted to form a seal with its pressure vessel from inside said vessel; said outlet valve including a passageway, said passageway being arranged to communicate between the inside and the outside of the pressure vessel; and an operating member, said operating member extending through and being slidably mounted in said passageway and said operating member including a nozzle, said nozzle projecting from said passageway, said outlet valve further including a projection, said projection being arranged to co-operate with said operating member whereby removal of the operating member from the passageway is prevented, said projection being movable to a position in which said operating member may be removed with said sealing member remaining adapted to seal its pressure vessel; said inlet valve including a sealing portion; the valves being adapted to co-operate with each other to transfer fluid out of the outlet valve in through the inlet valve by urging said nozzle against said sealing portion to form a seal between said nozzle and said sealing portion, said urging of said nozzle against said sealing portion also causing urging of said operating member towards said sealing member of said outlet valve to cause the seal of said member with its pressure vessel to be broken. In use, the operating member becomes damaged, particularly when it projects from the passageway, either through excess or prolonged periods of useage or through misuse. With a valve according to the present invention a damaged operating member may be removed from the outlet valve and replaced by an undamaged operating member without necessarily venting any pressure fluid which the outlet valve controls. Furthermore the pressurized vessel may be pressurized with fluid when the operating member of the outlet valve is removed, this being particularly useful when recharging a Carbon Dioxide cylinder.

The projection may comprise a threaded member extending through the part of the valve defining the passageway, or the projection may comprise a plate or ring plate secured to the end of the part of the valve defining the passageway. Both of these alternatives provide a quick and simple way of removing the operating member. When the operating member is retained by a threaded member, any person may be able to fit a new operating member, but when the plate or ring plate is secured to the end of the part of the valve defining the passageway, only an authorized person having the facilities to secure a new or the same plate back onto the correct part of the valve may be able to fit a new operating member.

BRIEF DESCRIPTION OF THE DRAWINGS

For a better understanding of the invention and to show how the same may be carried into effect, reference will now be made, by way of example, to the accompanying diagrammatic drawings, in which.

DESCRIPTION OF PREFERRED EMBODIMENTS

Figure 1:
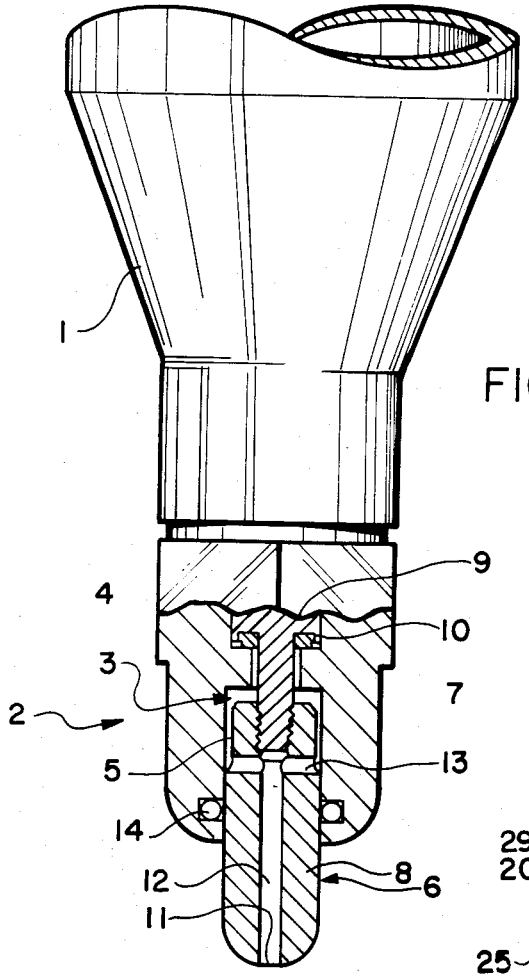
FIG. 1 shows part of a carbonating cylinder, provided with an outlet valve in accordance with the invention.

The carbonating cylinder 1 which is shown in FIG. 1 contains carbon dioxide under pressure, for instance about 360 lbs per square inch, which is arranged to be dispensed by the outlet valve 2. The outlet valve 2 may be secured to the carbonating cylinder 1 in a non-detachable manner—e.g. by welding—or may be detachably connected thereto—e.g. by means of cooperating screw threads.

The valve 2 comprises a passageway 3, having a reduced diameter portion 4 and an enlarged diameter portion 5. The reduced diameter portion 4 opens into the inside of the carbonating cylinder 1, whilst the enlarged diameter portion 5 opens to the outside of the cylinder 1. A piston 6 is slidably mounted within the passageway 3, and comprises a sealing member or reduced diameter portion 7 and an operating member or enlarged diameter portion 8 which co-operate respectively within the portions 4 and 5 of the passageway 3.

One end of the reduced diameter portion 7 of the piston 6 is provided with an enlarged head 9, within which there is mounted a sealing ring 10. The other end of the reduced diameter portion 7 screw-threadably engages the inner end of the enlarged diameter portion 8, to detachably secure the portions 7 and 8 together. The outer end of the piston is provided with a discharge nozzle 11 comprising a bore 12 which extends axially of the portion 8 and communicates with the passageway 3 via transverse ducts 13. A sealing ring 14 is provided adjacent the outer end of the passageway 3, and engages around the portion 8.

It can be seen from FIG. 1 that, if the enlarged diameter portion is unscrewed from the reduced diameter portion 7, the sealing ring 10 of the reduced diameter portion is still able to be urged into sealing engagement around the reduced diameter portion 4 under the pressure within the cylinder. Thus the enlarged diameter portion 6 may be conveniently replaced, should it become damaged through continual use or through mistreatment.

Figure 2:
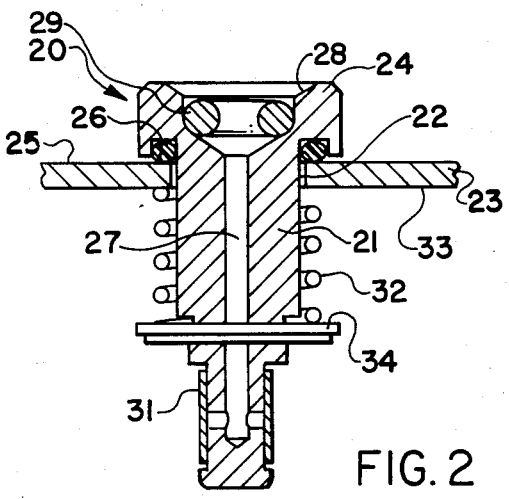
FIG. 2 shows an inlet valve in accordance with the invention, fitted in the wall of a beer keg.

The inlet valve 20 which is shown in FIG. 2 comprises a body 21 which extends through a hole 22 in the wall 23 of the beer keg.

The body 21 is formed with a head 24 which is adapted to bear against the outer wall 25 of the beer keg, with a sealing ring 26 interposed between the head 24 and the wall 25. A passageway 27 extends axially through the body 21, and terminates in a flared mouth 28, in which a sealing ring 29 is disposed. The lower end of the passageway 27 (as seen in FIg. 2) terminates in ports 30, which are covered by a flexible sleeve 31, which fits tightly around the lower portion of the body 21. A compression spring 32 is constrained between the inner wall 33 of the beer keg and a washer 34 which is mounted on the body 21. The pressure of the spring 32 serves to urge the head 24 towards the outer wall 25, and thereby cause the sealing ring 26 to provide a seal around the hole 22.

Figure 3:
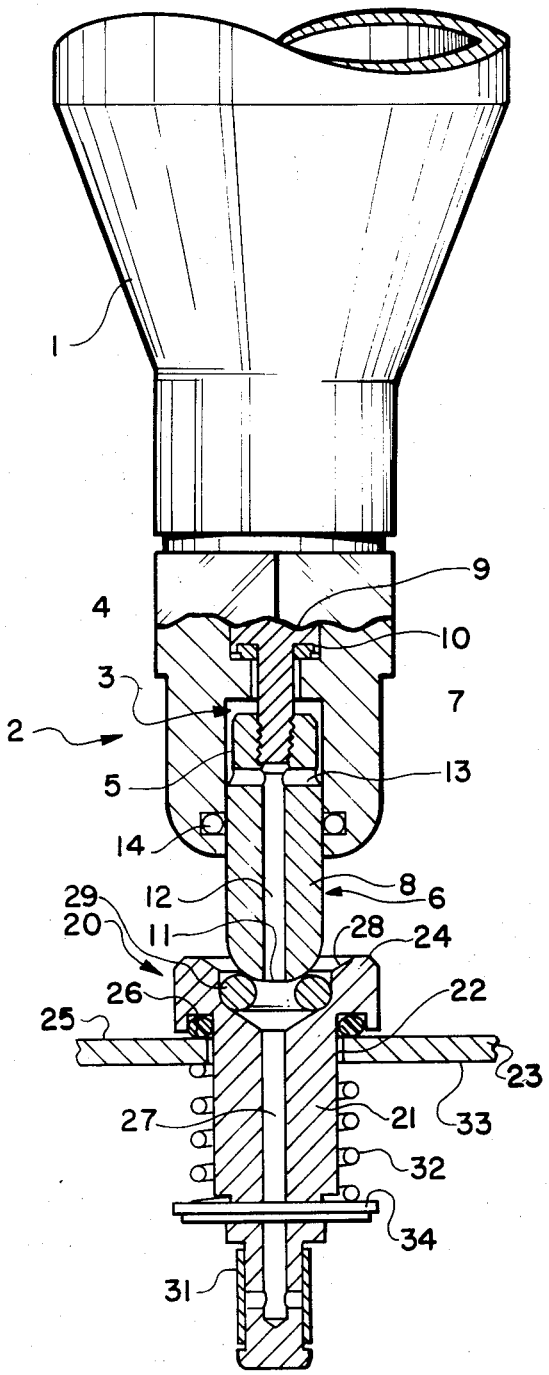
FIG. 3 illustrates the outlet valve positioned adjacent the inlet valve.

FIG. 3 illustrates the outlet valve 2 and the inlet valve 20 in use, to pressurize the beer keg by means of the carbon dioxide contained in the carbonating cylinder 1.

In FIG. 3, the discharge nozzle 11 bears against the sealing ring 29 of the inlet valve 20. Upon applying pressure of about 20 lbs force to the cylinder 1 in a downward direction (as seen in FIG. 3), relative movement of the piston 6 in the passageway 3 is caused in an upward direction, such that the sealing ring 10 is lifted from around the reduced diameter portion 4 of the passageway 3. Carbon dioxide under pressure is then allowed to flow through the annular clearance between the reduced diameter piston portion 7 and the reduced diameter passageway portion 4, and into the enlarged diameter passageway portion 5. The carbon dioxide is then free to pass through the ducts 13 and bore 12 and out of the discharge nozzle 11 into the passageway 27 of the inlet valve 20. The sealing ring 14 on the outlet valve 2 and the sealing ring 29 on the inlet valve 20 prevent escape of carbon dioxide to the atmosphere. The carbon dioxide under pressure then causes the resilient sleeve 31 to distend, to permit the carbon dioxide to pass out of the ports 30 and into the beer keg.

Upon releasing the downward pressure on the carbonating cylinder 1, the head 9 is urged downwardly (under the pressure of the carbon dioxide and/or under a resilient bias), until the sealing ring 10 is again seated around the inner end of the passageway 3. The resilient sleeve 31 seals the ports 30 against any escape of pressure from the beer keg. Thus, the carbonating cylinder 1 may be safely removed.

It will be appreciated that the beer keg may thus be pressurized as desired, in a simple and reliable manner, as many times as is required from the same cylinder 1. The outlet valve 2 provides safe and efficient sealing of the cylinder 1. In the event of the pressure within the beer keg exceeding a limit value, the corresponding force applied to the body 21 within the keg overcomes the force exerted by the spring 32, and causes the inlet valve 20 (as seen in FIG. 3) to lift, such that the sealing ring 26 parts from the outer wall 25 of the keg, to permit the keg to be vented. Thus, in addition to providing an effective inlet valve for co-operation with the outlet valve 2, the inlet valve 20 also serves as a safety valve to vent excess pressure within the beer keg, in a safe and reliable manner.

Figure 4:
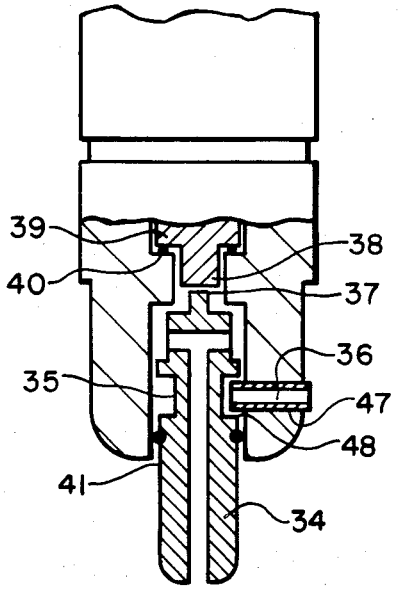
FIG. 4 shows part of a carbonating cylinder provided with an outlet valve in accordance with a further embodiment of the present invention.

FIG. 4 shows an alternative way of releasably retaining the enlarged diameter portion or operating member of the piston in the outlet valve. The operating member 34 includes a reduced diameter portion 35 at an intermediate location along its length. Within the intermediate portion 35 sits an end of a screw 36 with which the operating member is able to abut in order to limit its movement into or out of the valve. The inner end 37 of the operating member is able to abut with the outer end 38 of the reduced diameter portion or sealing member 39 and is able to push the sealing member 39 inwards to cause the sealing ring 40 thereof to be moved away from the wall of the container and allow pressurized fluid out of the container, as previously discussed in relation to FIGS. 1 to 3.

In order to replace the operating member 34, the screw 36, which threadably engages with the wall of the valve defining the enlarged diameter portion 41 by means of a threaded portion 48 on the screw 36 engaging with a threaded portion 47 extending through the wall of the valve is unscrewed until the end of the screw is clear of the operating member 34 to allow removal and replacement of the operating member. The new operating member is retained in position by returning the screw 36 to the position shown in the drawing.

Figure 5:
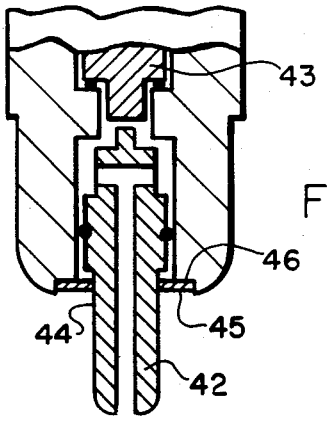
FIG. 5 is a view similar to FIG. 4 of an alternative embodiment of an outlet valve.

In FIG. 5 the operating member 42 co-operates with the sealing member 43 in the manner previously described in relation to FIG. 4. The outer end of the operating member, in the region of the outer end of the valve, includes a reduced diameter portion 44 which extends through a ring plate 45 secured to a recess 46 of the valve. The operating member 42 abuts the plate 45 to prevent removal thereof from the valve.

The ring plate 45 may be secured in the recess by any suitable means, for instance by adhesive or by welding. In order to remove the operating member 42 and replace the same on the valve the reduced diameter portion 44 of the operating member can be gripped and pulled outwardly to cause the plate 45 to break away from the valve. Alternatively, the plate 45 can be prized away from the valve. When the replacement operating member has been fitted, the same, or a replacement plate can be secured by any suitable means to the valve. It can be seen that with this embodiment only persons having the facility to remove and replace the plate are able to change a damaged operating member, or refill the cylinder, which may permit authorized personnel only to replace and refill the operating member.

What I claim is:

1. An inlet and an outlet valve for respective pressure vessels, adapted to cooperate with each other to transfer pressure fluid from one of the vessels to the other, the outlet valve including a sealing member, said sealing member being adapted to form a seal with its pressure vessel from inside said vessel; said outlet valve including a passageway, said passageway being arranged to communicate between the inside and the outside of the pressure vessel; and an operating member, said operating member extending through and being slidably mounted in said passageway and said operating member including a nozzle, said nozzle projecting from said passageway, said outlet valve further including a projection, said projection being arranged to cooperate with said operating member whereby removal of the operating member from the passageway is prevented, said projection being movable to a position in which said operating member may be removed with said sealing member remaining adapted to seal its pressure vessel; said inlet valve including a sealing portion; the valves being adapted to cooperate with each other to transfer fluid out of the outlet valve in through the inlet valve by urging said nozzle against said sealing portion to form a seal between said nozzle and said sealing portion, said urging of said nozzle against said sealing portion also causing urging of said operating member towards said sealing member of said outlet valve to cause the seal of said sealing member with its pressure vessel to be broken.

2. An inlet and an outlet valve according to claim 1 in which said projection comprises a plate member, said outlet valve including an end of the passageway from which said nozzle projects, said plate member being secured to said end of said passageway.

3. An inlet and an outlet valve according to claim 2 in which said plate member is secured in a recess in the end of said passageway of said outlet valve.

4. An inlet and an outlet valve according to claim 1 in which said projection comprises a threaded member extending through the part of the outlet valve defining the passageway.

* * * * *